US008393268B2

(12) United States Patent
Dubuit et al.

(10) Patent No.: US 8,393,268 B2
(45) Date of Patent: Mar. 12, 2013

(54) DOCTOR BLADE SUPPORT AND TOOL FOR LOOSENING THAT DOCTOR BLADE SUPPORT

(75) Inventors: Jean-Louis Dubuit, Paris (FR); Jose Albert Pontes, Noisy le Grand (FR); Daniel Troncon, Noisy le Grand (FR)

(73) Assignee: Machines Dubuit, Noisy le Grand (FR)

( * ) Notice: Subject to any disclaimer, the term of this patent is extended or adjusted under 35 U.S.C. 154(b) by 655 days.

(21) Appl. No.: 12/559,804

(22) Filed: Sep. 15, 2009

(65) Prior Publication Data

US 2010/0064914 A1 Mar. 18, 2010

(30) Foreign Application Priority Data

Sep. 16, 2008 (FR) ..... 08 56233

(51) Int. Cl.
*B05C 17/04* (2006.01)

(52) U.S. Cl. ..... 101/123; 15/245

(58) Field of Classification Search ..... 101/123, 101/124, 129; 15/236.01, 245, 256.5, 256.51
See application file for complete search history.

(56) References Cited

U.S. PATENT DOCUMENTS

| | | | | |
|---|---|---|---|---|
| 2,151,255 A | | 3/1939 | Witchger | |
| 3,261,956 A | * | 7/1966 | Mines et al. | 200/256 |
| 3,482,819 A | | 12/1969 | Leurent | |
| 3,483,819 A | * | 12/1969 | Hughes, Jr. | 101/123 |
| 3,973,491 A | * | 8/1976 | Porth et al. | 101/124 |
| 4,122,771 A | | 10/1978 | Barton et al. | |
| 4,817,524 A | * | 4/1989 | Riemer | 101/123 |
| 5,458,060 A | * | 10/1995 | Casl | 101/123 |
| 5,694,842 A | | 12/1997 | Casl | |

FOREIGN PATENT DOCUMENTS

| | | |
|---|---|---|
| CH | 212902 | 12/1940 |
| EP | 0099587 | 2/1984 |
| GB | 2242647 | 10/1991 |
| JP | 11030219 | 2/1999 |
| WO | 8001368 | 7/1980 |

OTHER PUBLICATIONS

French Search Report from FR0856233 dated May 7, 2009.

* cited by examiner

*Primary Examiner* — Ren Yan
(74) *Attorney, Agent, or Firm* — Young & Thompson

(57) ABSTRACT

A doctor blade support (2) for a machine for printing paste by silk screen printing, includes:

a doctor blade (6) of substantially square cross-section which is to come into contact with the meshes of a silk screen printing screen in order to apply the paste to an element to be printed;

a first (12) and a second (14) clamping jaws suitable for clamping the doctor blade (6);

at least two elements (20) for tightening the first clamping jaw (12) towards the second clamping jaw (14) in order to clamp or withdraw the doctor blade (6);

characterized in that each tightening element (20) includes a resilient element (40) applying a force between the two clamping jaws (12, 14) in order to move them towards each other, and elements for regulating the deformation of the resilient element (40).

19 Claims, 6 Drawing Sheets

DOCTOR BLADE SUPPORT AND TOOL FOR LOOSENING THAT DOCTOR BLADE SUPPORT

BACKGROUND OF THE INVENTION

1. Field of the Invention

The present invention relates to a doctor blade support used in silk screen printing machines.

In particular, the invention relates to a doctor blade support intended to print a silver- or aluminium-based conductor paste on a support, a substrate or a silicon wafer.

2. Description of the Related Art

Such printing machines are used in the field of microelectronics to produce printed circuits and in the field of the manufacture of solar wafers for the production of solar panels.

Conductor pastes must be printed regularly at a constant thickness in order not to impair the electrical characteristics of the circuits or solar panels so formed.

In addition, the pattern to be printed must be reproduced with precision.

As a strong pressure is necessary to transfer the conductor paste from the screen to the element to be printed, the doctor blade support must have a high degree of rigidity.

In order to produce such printing, a doctor blade composed of synthetic elastomeric material is secured in a metal support.

The doctor blade has a rectangular parallelepipedal shape of substantially square cross-section. It is generally obtained by cutting a strip from a sheet of elastomeric material. This cutting operation brings about variations in the dimensioning of the square cross-section greater than one tenth of a millimeter.

For printing, the doctor blade support is displaced in accordance with a translational movement above a screen for silk screen printing placed above the element to be printed. A pressing force is exerted on the doctor blade during its displacement in order to force the conductor paste to pass through the open meshes of the screen in order to deposit a pattern to be printed on the element to be printed.

In order to print conductor pastes in a uniform manner, and with a high degree of precision, in particular the U.S. Pat. No. 3,482,819 has proposed a doctor blade support carrying a doctor blade of synthetic elastomeric material having a square cross-section, one of the corners of which forms the surface in contact with the screen. This doctor blade is clamped between two metal clamping jaws reproducing the shape of the square cross-section of the doctor blade. Only a small portion of the corner of the doctor blade projects relative to the two clamping jaws. Generally, the doctor blade is clamped in the clamping jaws in such a manner that one of the diagonals of the square cross-section of the doctor blade is in a vertical plane, so that the angle formed between the surface of the screen and one of the faces of the doctor blade is equal to 45°.

The document U.S. Pat. No. 4,122,771 proposes a variant of that doctor blade support in which the angle formed between the surface of the screen and one of the faces of the doctor blade is equal to 30°.

In the documents U.S. Pat. No. 3,482,819 and U.S. Pat. No. 4,122,771, the clamping jaws of the doctor blade supports are secured to each other by several screws aligned in the longitudinal direction of the clamping jaws.

The clamping jaws of the doctor blade supports may also be secured to each other by a single tightening handle as described, for example, in the document U.S. Pat. No. 5,458,060.

The doctor blade obtained does not always have a completely uniform cross-section along the entire parallelepiped, so that, after the tightening of the tightening handle described in the document U.S. Pat. No. 4,122,771, or even of the screws of the doctor blade supports described in the documents U.S. Pat. No. 3,482,819 and U.S. Pat. No. 4,122,771, the fine edge of the corner of the doctor blade is not completely flat and straight. It has protuberances at the sites where the area of the cross-section of the doctor blade is largest. For, at those sites, the force exerted by tightening has the effect of causing the fine edge of the corner of the doctor blade to bulge by compression of the elastomeric material. Of course, in order to avoid such a phenomenon, all that is required is to tighten to a slightly lesser extent at those sites.

In practice, the tightening is adjusted in accordance with the straightness of the fine edge of the corner of the doctor blade by placing the doctor blade on a surface plate before it is mounted in the machine. Such a regulation of the tightening may involve major time losses, the duration of this regulation being in accordance with the tolerances in the cross-section of the doctor blade.

BRIEF SUMMARY OF THE INVENTION

The object of the present invention is to provide a doctor blade support which receives doctor blades of not always uniform cross-section and which does not require such tedious regulation and which always enables a conductor paste to be printed regularly, precisely and at a constant thickness on the element to be printed.

To that end, the invention relates to a doctor blade support for a silk screen printing machine, comprising:

- a doctor blade of substantially square cross-section which is to come into contact with the meshes of a silk screen printing screen in order to apply the paste to an element to be printed;
- a first and a second clamping jaws suitable for clamping the doctor blade;
- at least two means for tightening the first clamping jaw towards the second clamping jaw in order to clamp or withdraw the doctor blade;

characterised in that each tightening means comprises a resilient element applying a force between the two clamping jaws in order to move them towards each other, and means for regulating the deformation of the resilient element.

According to particular embodiments, the doctor blade support comprises one or more of the following features, taken in isolation or in combination:

- the resilient elements of each tightening means have the same stiffness constant, so that the force exerted by the tightening means on the first and the second clamping jaws is constant for the same deformation of the resilient elements of each tightening means;
- the resilient means are compression springs;
- the length of all of the compression springs is equal in order to apply a constant force to the doctor blade along the entire length thereof;
- the regulating means comprise a template;
- each tightening means comprises:
  - a through-opening formed in the first clamping jaw;
  - an at least partially threaded rod suitable for being secured to the second clamping jaw, the rod being moveable in the opening of the first clamping jaw; and
  - a nut screwed onto the threaded portion of the rod in order to move the second clamping jaw towards the first clamping jaw;
- the nut is a self-locking nut;

the doctor blade has a substantially square cross-section, the first and the second clamping jaw comprising V-shaped grooves which are suitable for each receiving a portion of the doctor blade so that the diagonal of the square cross-section of the doctor blade extends substantially parallel with the major faces of the clamping jaws, the fine edge of the corner of the doctor blade coming into contact with the meshes of the screen in order to apply the conductor paste to the element to be printed;

the doctor blade support comprises means for loosening the clamping jaws which are separate from the means for tightening the clamping jaws, the loosening means comprise a rod screwed into a threaded orifice of the first clamping jaw, the end of the rod being suitable for coming into abutment with a surface of the second clamping jaw in order to move the second clamping jaw away from the first clamping jaw, during the screwing of the rod into the threaded orifice of the first clamping jaw;

at least one portion of each of the edges of the mutually opposing faces of the first and the second clamping jaw is bevelled in order to enable the clamping jaws of the doctor blade support to move apart.

The invention relates also to a tool for loosening two clamping jaws of a doctor blade support, characterised in that the tool comprises:

a profile suitable for carrying the doctor blade support;

at least one upright secured to the profile and extending perpendicularly to the major face of the profile;

at least one press-screw which has a pointed end and which is screwed into an opening in the upright and the purpose of which screw is to be inserted between the bevelled edge portions of the first and the second clamping jaw in order to move them away from each other.

BRIEF DESCRIPTION OF THE DRAWINGS

The invention will be better understood on reading the following description which is given purely by way of example with reference to the appended drawings, in which.

DETAILED DESCRIPTION OF THE PREFERRED EMBODIMENTS

Figure 1:
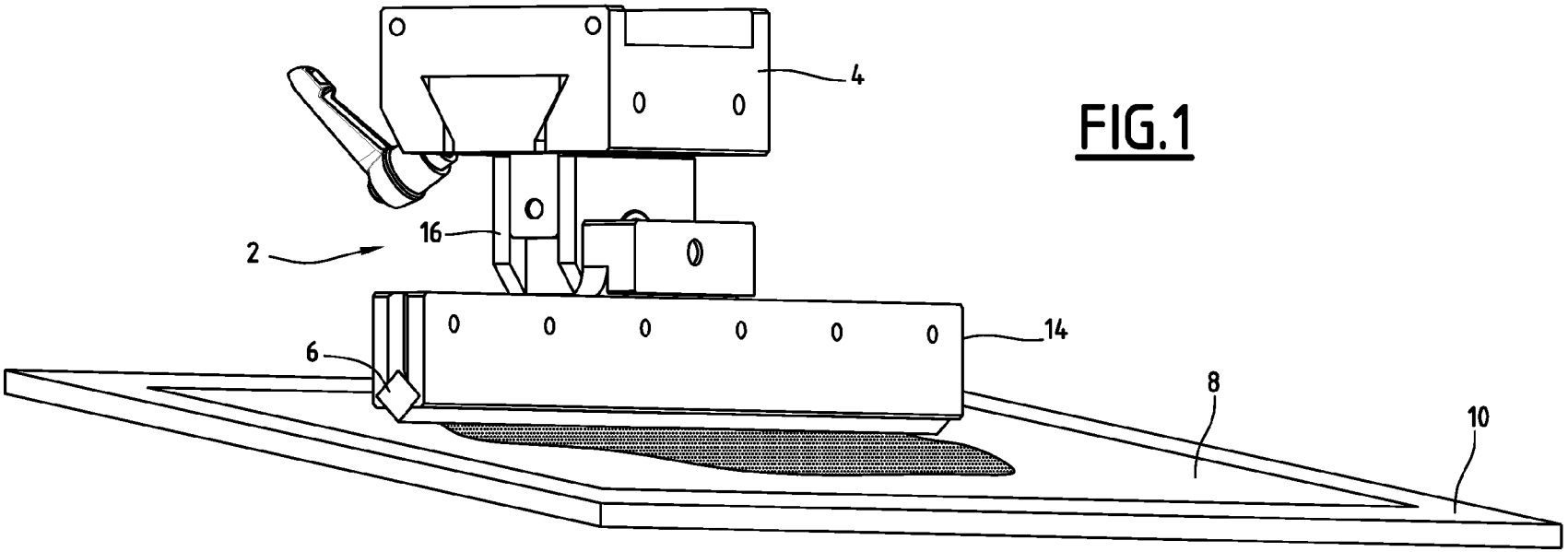
FIG. 1 is a perspective view of a doctor blade support secured to a carrier block thereof.

With reference to FIG. 1, the doctor blade support 2 according to the invention is secured to a carrier block 4 capable of being displaced vertically in order to press a doctor blade 6 against the meshwork 8 of a silk screen printing screen 10 in order to apply a conductor paste to a wafer or substrate generally composed of silicon.

The doctor blade 6 has a rectangular parallelepipedal shape of substantially square cross-section.

Figure 2:
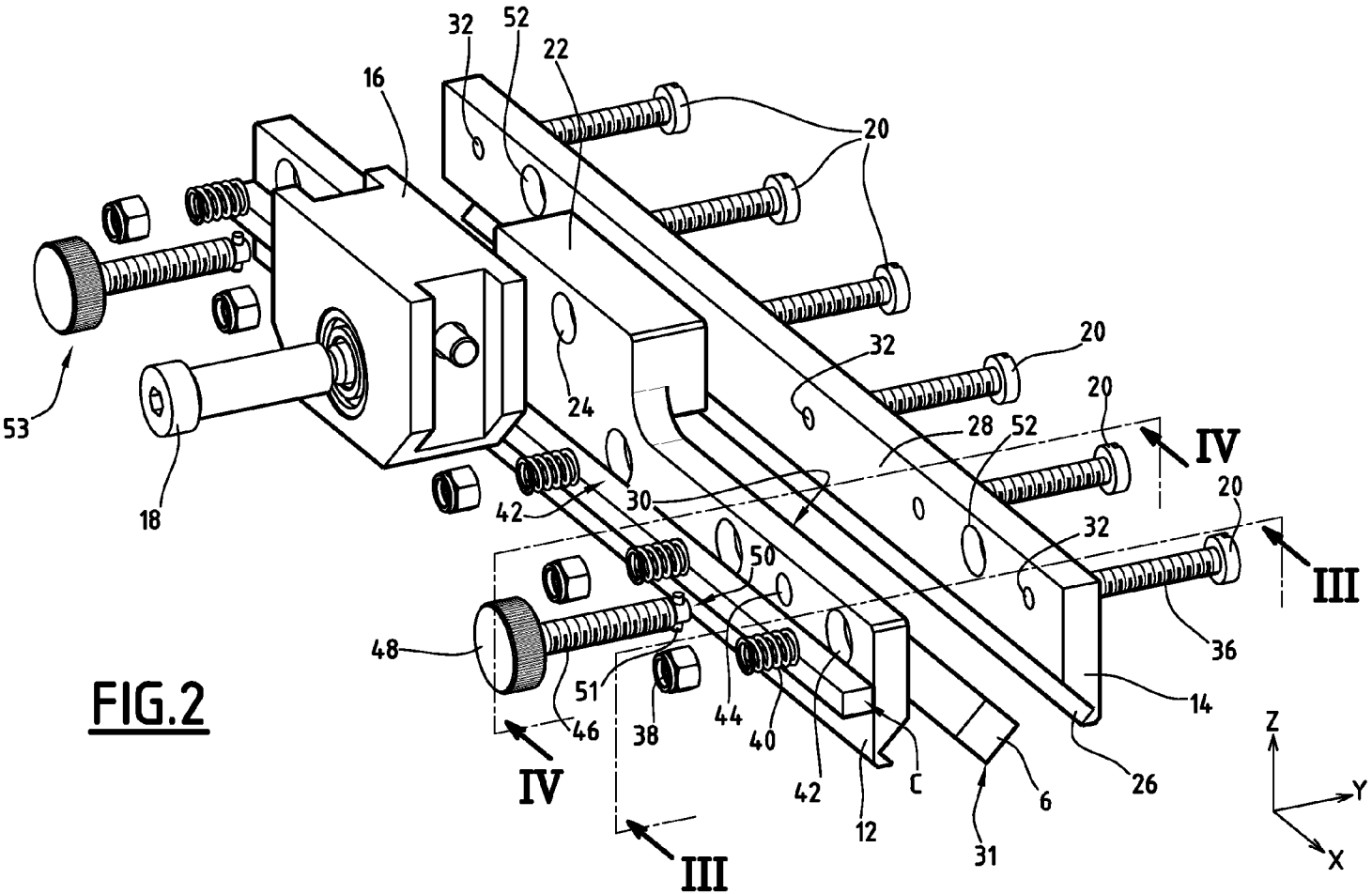
FIG. 2 is a perspective view of a doctor blade support according to a first embodiment of the invention.
Figure 4:
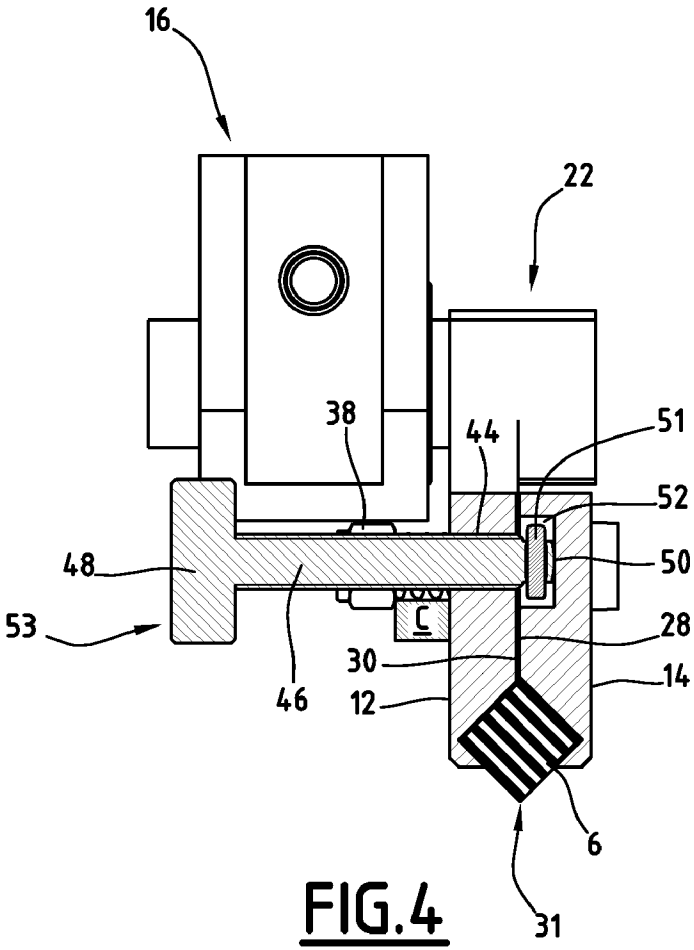
FIG. 4 is a view, sectioned in accordance with the plane IV.IV, of the doctor blade support illustrated in FIG. 2.
Figure 3:
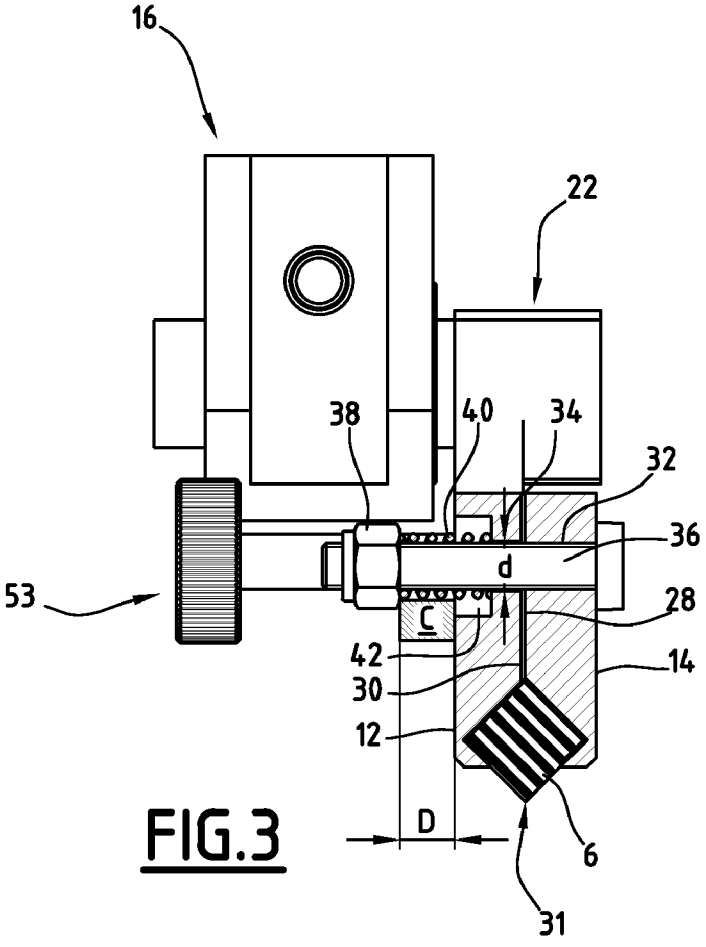
FIG. 3 is a view, sectioned in accordance with the plane III.III, of the doctor blade support illustrated in FIG. 2.

According to a first embodiment of the invention illustrated in FIGS. 2 to 4, the doctor blade support 2 is formed by a first 12 and a second 14 clamping jaw, and a doctor blade head 16 articulated to the first clamping jaw 12 by means of a hub 18. The doctor blade head 16 is secured to the carrier block 4.

The clamping jaws 12 and 14 have a generally rectangular parallelepipedal shape. They extend in a plane X-Z in FIG. 2. They are connected to each other by several regulatable tightening means 20.

The clamping jaws 12 and 14 are suitable for clamping the doctor blade 6.

A lug 22 projects in a central portion of the upper section of the first clamping jaw 12. It is provided with a hole 24 through which the hub 18 extends in order to enable the clamping jaws 12, 14 to pivot relative to the doctor blade head 16.

A groove 26 is formed in the faces 28, 30 of the mutually opposing clamping jaws. This groove 26 extends along the lower edge of the faces 28, 30 of the clamping jaws.

Each groove 26 is in the shape of a V inclined by an angle of 90° and having an opening of 90°. The V shape is open in the direction towards the opposing face of the other clamping jaw. The upper branch of this V shape has a slightly smaller length than the length of one side of the square cross-section of the doctor blade 6.

The grooves 26 are suitable for each receiving a portion of the doctor blade 6, so that the diagonal of the square cross-section of the doctor blade 6 extends parallel with the major faces of the clamping jaws 12, 14. Thus, the fine edge of the corner 31 of the doctor blade 6 comes into contact with the meshes 8 of the screen in order to apply the conductor paste to the element to be printed.

The area of the square cross-section of the doctor blade 6 is slightly larger than the area of the opening formed by the grooves 26 which are to receive the doctor blade.

The first 12 and the second 14 clamping jaws comprise in their upper portion several, for example six, holes 32 and 34, respectively, having common axes.

The holes 32 are tapped. The holes 34 are smooth and have a slightly larger diameter than the diameter of the screws 36 guided in the holes 34.

Screws 36 are screwed into the openings 32.

A self-locking nut 38 is screwed to the end of each screw 36. The screws 36 and the nuts 38 form regulatable means 20 for tightening the first clamping jaw 12 against the second clamping jaw 14.

Six compression springs 40 are mounted between the first clamping jaw 12 and each nut 38 of each tightening means 20.

The spring 40 is suitable for transmitting the tightening force exerted by the nut 38 and by the head of the screw 36 in order to move the clamping jaws 12, 14 towards each other. The set of six springs 40 has the same stiffness constant k so that the length of each spring 40 is representative of the tightening force exerted on the doctor blade 6 by the nut 38 in contact with this spring.

In order to apply a constant tightening force to the doctor blade 6 by the various tightening means 20, the compression of the six springs 40 must be identical. This compression can be measured by means of a template or a distance piece arranged between the nut 38 and the first clamping jaw 12.

Thus, the springs 40 form a means of checking the force exerted by the tightening means 20 on the doctor blade 6 at the site where the tightening means is located. This force is practically constant, even if there is a variation in the thickness of the doctor blade at the site where the tightening means is located, since the force exerted on the doctor blade 6 is proportional to the length of the compressed spring. For example, a variation of one tenth of a millimeter in the length of the spring for a length of spring of 10 mm brings about a variation of less than 1% in the force exerted on the doctor blade. This variation is negligible because it cannot cause a deformation of the doctor blade.

Countersinking 42, shown in FIG. 3, is produced around the hole 34 in the first clamping jaw 12 in order to receive a portion of the spring 40.

The first 12 and the second 14 clamping jaws also comprise two tapped through-holes 44 in which are mounted two threaded rods 46 equipped at one of their ends with a wheel 48 and at the other end with an abutment element 50.

A pin 51 is secured to the end of each threaded rod 46 near the abutment element 50.

When a user causes the wheel 48 to pivot on itself, the abutment element 50 applies a force against the second clamping jaw 14 in order to move it away from the first clamping jaw 12 and thus, for example, to enable the doctor blade 6 to be changed.

In the embodiment illustrated in FIGS. 2 and 4, the pin 51 is accommodated in a recess 52 formed in the face 28 of the second clamping jaw. The pin 51 and the recess 52 have a slightly larger diameter than the diameter of the hole 44 and of the rod 46, so that the loosening means 53 cannot be withdrawn from the first clamping jaw 12 and lost.

The threaded rod 46 provided with the wheel 48 and with the abutment element 50 constitutes a means 53 for loosening the clamping jaws and moving them away from each other. This loosening means 53 has no influence on the two clamping jaws 12, 14 at the moment when they are tightened.

Advantageously, the loosening means 53 is separate from the tightening means 20.

In a variant, the hole 32 is not tapped, and the spring 40 is arranged between the screw head and the second clamping jaw 14, the screw 36 being secured to the first clamping jaw 12.

In another variant, the screw 36 is replaced by a threaded rod secured to the second clamping jaw 14.

According to a third variant, the compression spring 40 is replaced by a leaf spring, a Belleville washer or a spring in the shape of a gendarme's two-pointed hat.

Figure 5:
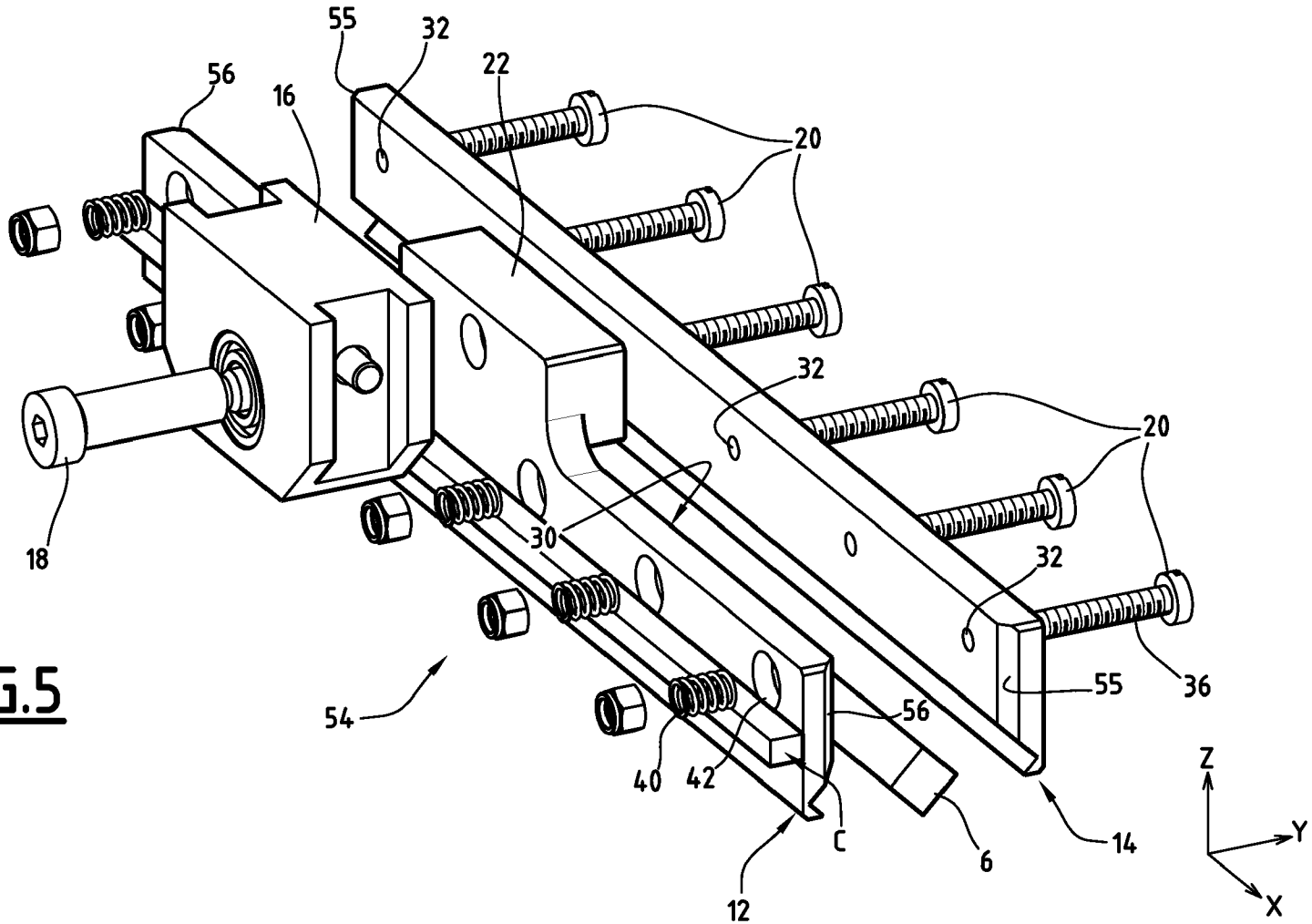
FIG. 5 is a perspective view of a doctor blade support according to a second embodiment of the invention.

The doctor blade support 54 according to the second embodiment of the invention is illustrated in FIG. 5. The elements of the second embodiment of the doctor blade support that are identical to the elements of the first embodiment bear the same references and will not be described a second time.

The doctor blade support 54 comprises the same elements as the doctor blade support 2 according to the first embodiment except that the means 53 for loosening the clamping jaws is constituted by a separate tool, and that each of the edges 55, 56 of the mutually opposing faces 28, 30 of the first 12 and the second 14 clamping jaw is bevelled in order to enable the clamping jaws 12, 14 to move apart with the aid of a loosening tool 57 independent of the doctor blade support 54.

The bevelled edges 55, 56 are located between the faces 28, 30 and the lateral sections of the clamping jaws 12, 14.

In a variant, only a portion of the edges 55, 56 is bevelled.

The loosening tool 57 is used solely when the doctor blade 6 has to be changed.

Figure 6:
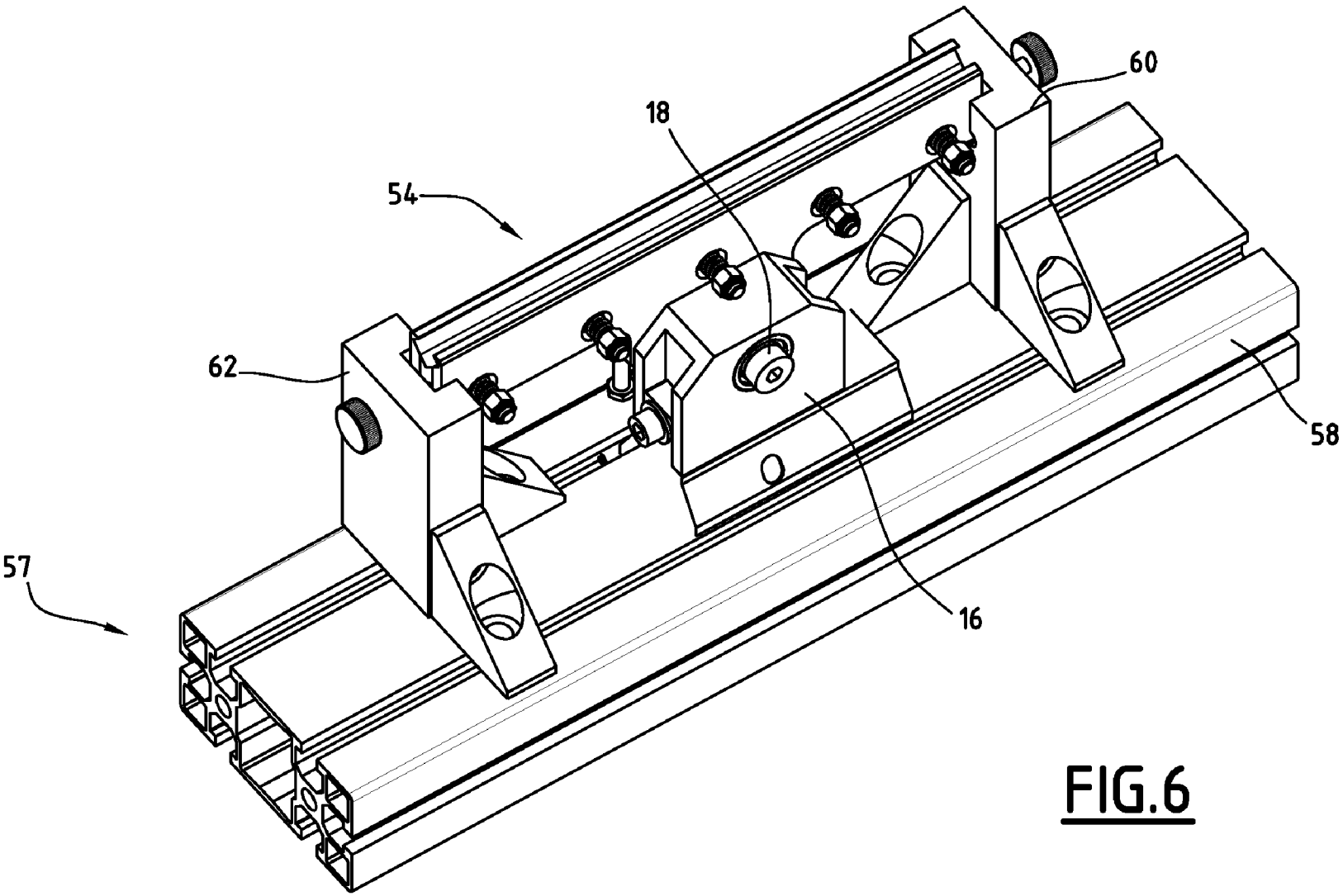
FIG. 6 is a perspective view of a tool for loosening the clamping jaws of the doctor blade support according to the second embodiment of the invention.
Figure 7:
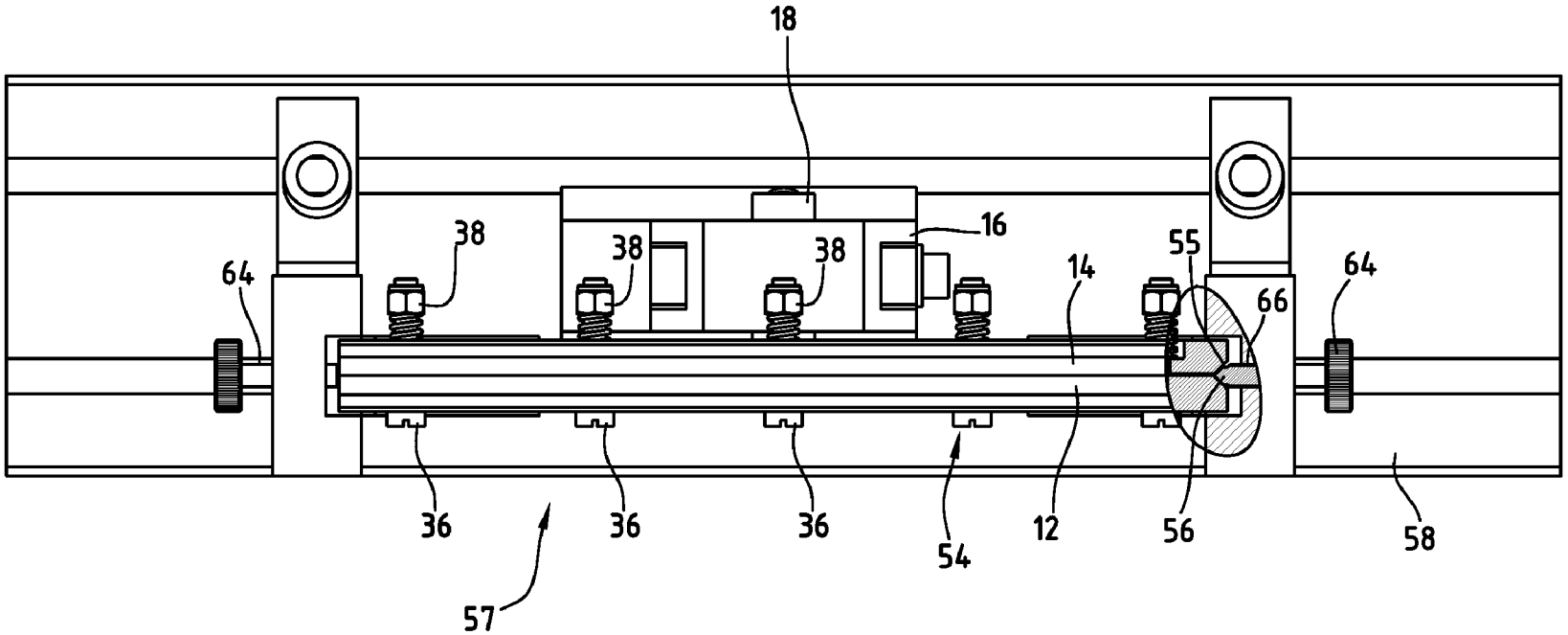
FIG. 7 is a top view of the loosening tool illustrated in FIG. 6.

Referring to FIGS. 6 and 7, the tool 57 for loosening the doctor blade support 54 comprises a support profile 58 on which two uprights 60, 62 are secured in such a manner as to be separated from each other by a distance corresponding to the length of the doctor blade support 54.

The uprights 60, 62 extend in a direction perpendicular to the principal plane of the support profile 58.

A press-screw 64 having a pointed end is screwed into a threaded opening 66 in the upright 60. The screw 64 is to be inserted between the bevelled edges 55, 56 of the first 12 and the second 14 clamping jaws in order to move them away from each other.

The invention relates also to a method for tightening the doctor blade support according to the first and second embodiment of the invention. The method comprises the following steps:

- mounting the doctor blade 6 between the first 12 and the second 14 clamping jaws;
- securing the threaded rod 36 to the second clamping jaw 14 for each tightening means 20;
- screwing a nut 38 onto the end of each threaded rod 36 for each tightening means 20;
- checking that the distance D between the nut 38 and the first clamping jaw 12 is identical for all of the tightening means 20.

Advantageously, the fine edge of the corner of the doctor blade mounted in the doctor blade support according to the invention is planar and rectilinear, even when the doctor blade has a cross-section of non-uniform size along its entire length.

Also advantageously, the doctor blade support according to the invention is readily loosened either with the loosening means or with the independent loosening tool.

The invention claimed is:

1. A doctor blade support for a machine for printing paste by silk screen printing, the doctor blade support comprising:

- a doctor blade of substantially square cross-section configured to come into contact with meshes of a silk screen printing screen in order to apply the paste to an element to be printed, the doctor blade being made of an elastomeric material;
- a first clamping jaw and a second clamping jaw configured to clamp the doctor blade; and
- at least two means for tightening the first clamping jaw towards the second clamping jaw in order to clamp or withdraw the doctor blade, each tightening means comprising a resilient element applying a force between the two clamping jaws in order to move the two clamping jaws towards each other, and means for regulating the deformation of the resilient element, the resilient elements of the at least two tightening means being arranged such that a constant force is applied by the resilient elements to the doctor blade along the entire length thereof.

2. The doctor blade support according to claim 1, wherein the resilient elements have the same stiffness constant, so that the force exerted by the tightening means on the first and the second clamping jaws is constant for the same deformation of the resilient elements of the tightening means.

3. The doctor blade support according to claim 2, wherein the resilient elements are compression springs.

4. The doctor blade support according to claim 2, wherein the length of all of the compression springs is equal in order to apply the constant force to the doctor blade along the entire length thereof.

5. The doctor blade support according to claim 2, wherein the regulating means comprise a template.

6. The doctor blade support according to claim 2, wherein each tightening means comprises:

- a through-opening formed in the first clamping jaw (12);
- an at least partially threaded rod configured to be secured to the second clamping jaw, the rod being moveable in an opening of the first clamping jaw; and a nut screwed onto the threaded portion of the rod in order to move the second clamping jaw towards the first clamping jaw.

7. The doctor blade support according to claim 2, wherein the first and the second (14) clamping jaws each comprise V-shaped grooves which are suitable for each receiving a portion of the doctor blade so that the diagonal of the square cross-section of the doctor blade extends substantially parallel with the major faces of the clamping jaws, a fine edge of a corner of the doctor blade coming into contact with the meshes of the screen in order to apply the paste to the element to be printed.

8. The doctor blade support according to claim 2, further comprising means for loosening the clamping jaws, separate from the means for tightening the clamping jaws.

9. The doctor blade support according to claim 2, wherein at least one portion of each of edges of mutually opposing faces of the first and the second clamping jaw is bevelled in order to enable the clamping jaws of the doctor blade support to move apart.

10. The doctor blade support according to claim 1, wherein the resilient elements are compression springs.

11. The doctor blade support according to claim 10, wherein the length of all of the compression springs is equal in order to apply the constant force to the doctor blade along the entire length thereof.

12. The doctor blade support according to claim 1, wherein the regulating means comprise a template.

13. The doctor blade support according to claim 1, wherein each tightening means further comprises:

a through-opening formed in the first clamping jaw;

an at least partially threaded rod configured to be secured to the second clamping jaw, the rod being moveable in an opening of the first clamping jaw; and a nut screwed onto the threaded portion of the rod in order to move the second clamping jaw towards the first clamping jaw.

14. The doctor blade support according to claim 13, wherein the nut is a self-locking nut.

15. The doctor blade support according to claim 1, wherein the first and the second clamping jaws each comprising V-shaped grooves which are suitable for each receiving a portion of the doctor blade so that the diagonal of the square cross-section of the doctor blade extends substantially parallel with the major faces of the clamping jaws, a fine edge of a corner of the doctor blade coming into contact with the meshes of the screen in order to apply the paste to the element to be printed.

16. The doctor blade support according to claim 1, further comprising means for loosening the clamping jaws, separate from the means for tightening the clamping jaws.

17. The doctor blade support according to claim 16, wherein the loosening means comprise a rod screwed into a threaded orifice of the first clamping jaw, an end of the rod being configured to come into abutment with a surface of the second clamping jaw in order to move the second clamping jaw away from the first clamping jaw, during the screwing of the rod of the loosening means into the threaded orifice of the first clamping jaw.

18. The doctor blade support according to claim 1, wherein at least one portion of each of edges of mutually opposing faces of the first and the second clamping jaw is bevelled in order to enable the clamping jaws of the doctor blade support to move apart.

19. The doctor blade support according to claim 1, wherein the means for regulating the deformation of the resilient elements having a same width at each of the tightening means.

* * * * *